United States Patent [19]

Westberg

[11] 4,230,263

[45] Oct. 28, 1980

[54] APPARATUS FOR ACCOMPLISHING UNLIMITED RELATIVE ROTATION OF THE ENDS OF A FILIFORM TRANSMISSION ELEMENT

[75] Inventor: Johan E. H. Westberg, Lidingö, Sweden

[73] Assignee: Separex Teknik AB, Stockholm, Sweden

[21] Appl. No.: 930,389

[22] Filed: Aug. 2, 1978

[30] Foreign Application Priority Data

Aug. 3, 1977 [SE] Sweden ..... 7708858

[51] Int. Cl.[2] ..... B04B 9/00

[52] U.S. Cl. ..... 233/23 R; 233/27

[58] Field of Search ..... 233/14 R, 25, 26, 27, 233/28, 23 R, 24; 210/31 C

[56] References Cited

U.S. PATENT DOCUMENTS

| | | | |
|---|---|---|---|
| 3,657,941 | 4/1972 | Engler | 74/417 |
| 3,856,413 | 6/1971 | Adams | 350/7 |
| 3,856,669 | 12/1974 | Ito et al. | 210/31 C |
| 4,007,871 | 2/1977 | Jones et al. | 233/27 |
| 4,056,224 | 11/1977 | Lolachi | 233/14 R |
| 4,082,217 | 4/1978 | Westberg | 233/25 |
| 4,113,173 | 9/1978 | Lolachi | 233/25 |
| 4,120,449 | 10/1978 | Brown et al. | 233/23 R |

*Primary Examiner*—George H. Krizmanich

*Attorney, Agent, or Firm*—Hill, Van Santen, Steadman, Chiara & Simpson

[57] ABSTRACT

An apparatus for continuously transmitting electrical energy or a fluid stream between a fixed terminal and a continuously rotating terminal through a flexible continuous transmission element, such as an electric cable or a tube, comprises three rotors having a common axis of rotation, namely an outer rotor, an intermediate rotor and an inner rotor. The outer and intermediate rotors are rotated at approximately equal speeds in opposite directions, and the inner rotor is driven by the torsionally rigid, filiform transmission element in the same direction as the intermediate rotor at a speed equal to twice the sum of the speeds of the outer and intermediate rotors. The transmission element extends between the fixed and rotating terminals in an outer bight supported by the outer rotor and an inner bight supported by the intermediate rotor and is rotatable about its own curvilinear axis relative to the rotors. The bights are shaped like a fishhook or an interrogation mark so that the ends of each bight point in the same direction. A centrifugal separation unit adapted for use with the apparatus comprises a separation container supported by the inner rotor, a bundle of flexible tubes connected to the separation container, and a torque-transmitting sheathing wrapped around the bundle of tubes.

13 Claims, 4 Drawing Figures

APPARATUS FOR ACCOMPLISHING UNLIMITED RELATIVE ROTATION OF THE ENDS OF A FILIFORM TRANSMISSION ELEMENT

BACKGROUND OF THE INVENTION

1. Field of the Invention

This invention relates to apparatus providing a continuous energy or fluid transmission between a stationary and a continuously rotating element.

2. Prior Art

There are numerous devices and machines requiring a continuous energy or fluid flow communication between elements which are continuously rotating relative to one another in one and the same direction. For example, an electric current or a stream of gas or liquid may have to be transmitted between a stationary element and a continuously rotating element. It is common practice in such instances to use coupling devices of the slip-ring or rotary-seal type, i.e. devices having interengaging relatively rotating parts. Such devices, however, often cause problems. Thus, in the case of electric slip-ring coupling devices noise, varying contact resistance and wear may cause problems, and in the case of rotary seals the main problem is the difficulty of providing a reliable fluid-tight seal between the relatively rotating parts.

It is possible, however, to transmit through a flexible electrical cable, flexible tube or other continuous, flexible filiform transmission element, an electric current or a stream of liquid or gas from a stationary, non-rotating terminal to a continuously rotating terminal without using a coupling device of the slip-ring or rotary-seal type. Thus, it is feasible to fasten one end of the filiform transmission element to the stationary terminal and fasten the other end of the transmission element to the rotating terminal and to effect the transmission through the transmission element without twisting the latter.

In a prior art device permitting such transmission, a filiform transmission element in the form of a flexible tube or a flexible electric cable has one end vertical and immovably secured to a stationary part while its other end is horizontal and rotatably supported on a main rotor. The axis of rotation of the main rotor is vertical and passes through the first end of the transmission element. As the main rotor, and hence the right-angle bight or bend formed by the transmission element, rotate about the vertical axis, the horizontal end of the transmission element rotates about its own horizontal axis at the same rotational speed as the main rotor, provided that no twisting of the transmission element takes place. The horizontal end of the transmission element is fastened to a secondary rotor which is supported on the main rotor and rotatable about the longitudinal axis of the horizontal end of the transmission element. Using this arrangement, an electric current or a stream of gas or liquid can be continuously transmitted from the immovably secured end into the continuously rotating secondary rotor. Examples of such arrangements are shown in U.S. Pat. Nos. 3,657,941 and 3,856,669.

The above-described prior art device may be modified by further bending the transmission element such that its ends point in the same direction and mounting the secondary rotor for rotation about an axis which is substantially parallel to, and preferably coincident with, the axis of rotation of the main rotor. The bend or bight formed by the transmission element thus resembles a fishhook or an interrogation mark. If this bight, which is journalled in the main rotor for rotation about its own curved longitudinal axis relative to the main rotor, is caused to revolve about the axis of rotation of the main rotor and the secondary rotor is caused to rotate in the same direction but at twice the rotational speed at which the bight revolves, the rotational movements cause no twisting of the transmission element. A device modified in the above-described manner is shown in U.S. Pat. No. 3,586,413.

The modified device may be embodied e.g. as a centrifuge for the continuous separation of blood into two fractions, a plasma fraction and a blood cell fraction. A known centrifuge of this type (U.S. Pat. No. 4,056,224) comprises two rotors, namely, an outer rotor (the main rotor) which is mounted in a base and rotates relative to the base about a common vertical axis, and an inner rotor (the secondary rotor), which is rotatably mounted in the outer rotor and caused to rotate relative to it about the common vertical axis. A drive system comprising a motor and a transmission system interconnecting the two rotors rotates the rotors in the same direction relative to the base, the inner rotor rotating at twice the speed of the outer rotor.

The inner rotor carries a separation container to which a filiform transmission element formed by a bundle of flexible tubes is fastened. The bundle of tubes extends downwardly from the inner rotor or the separation container at a point on or near the vertical axis of rotation and then radially outwardly and upwardly around the region occupied by the inner rotor and then extends radially inwardly back to the vertical axis of rotation, where the bundle is fastened to the base by a clamp or other holder. The tip of the bight formed by the bundle of tubes, which resembles a fishhook or an inverted interrogation mark, is adjacent the separation container on the inner rotor while the shank extends through the clamp or holder on the base. This bight revolves around the vertical axis as the outer rotor rotates.

Blood is continuously fed into the separation container through one of the flexible tubes, and one or both of the plasma and blood cell fractions formed in the separation container are continuously withdrawn through the other tubes. The separation thus is effected continuously without any contacting of the blood or the fractions with relatively rotating parts during the passage between the continuously rotating separation container and the portion of the tubes fastened to the base. It is easy, therefore, to maintain the separation system completely closed, i.e. to completely isolate the blood and the blood fractions from the surrounding environment. This, in turn, means that the separation may be carried out in sterile conditions. Moreover, since the blood or the blood fractions are not contacted by any relatively rotating parts, mechanical damage on the blood cells is avoided.

The individual tubes or the bundle of tubes need not be capable of accommodating any appreciable degree of twisting as long as the inner rotor rotates at exactly twice the speed of the outer rotor. In the known centrifuge the exact 2:1 speed ratio is ensured by rotationally interconnecting the rotors by means of a gear or gear belt transmission. Since the bundle of tubes has to rotate about its own curvilinear, fishhook-shaped longitudinal axis relative to the outer rotor, namely at a speed equal to the speed at which the outer rotor rotates relative to the base, the friction between the bundle of tubes and the outer rotor gives rise to certain problems. In addition, the presence of air bubbles in the tubes may result in blocking of the flow through the tubes. These problems are caused by the centrifugal force which presses the tubes against the surfaces on the outer rotor retaining or guiding them and of course also acts on the liquid in the tubes; in accordance with well-known laws of physics the magnitude of the centrifugal force is proportional both to the distance from the axis of rotation and the square of the speed at which the bight formed by the tubes revolves around the axis of rotation, i.e. the square of the speed of the outer rotor.

Consequently, even a relatively small reduction of the speed of the outer rotor would result in a substantial reduction of the friction between the tubes and the outer rotor. On account of the given speed ratio, this would result in a substantial reduction of the speed of the inner rotor and hence of the centrifugal force on the blood in the separation vessel.

SUMMARY OF THE INVENTION

It is an object of the invention to provide an apparatus of the kind which has been exemplified here by reference to its use as a centrifuge, in which the speed at which the bight formed by the filiform transmission element revolves is considerably lower than half the rotational speed of the secondary or inner rotor.

It is a further object of the invention to provide a centrifugal separation unit of the type comprising a separation container and flexible tubes for conveying liquid into or out of the separation container, which separation unit is adapted for use in the apparatus of the invention.

These and other objects are realized in apparatus and centrifugal separation units constructed in accordance with the appended claims.

The apparatus comprises three relatively rotating rotors, an outer rotor, an intermediate rotor mounted for rotation opposite to the direction of rotation of the outer rotor, and an inner rotor, which may incorporate or support the separation container in the case where the apparatus is used as a centrifuge. The filiform transmission element has one end non-rotatably secured to the inner rotor and extends from the inner rotor through the intermediate rotor and the outer rotor to a holder on the base of the apparatus, changing its direction by 180° twice, so that its ends point in opposite directions. The transmission element thus forms two opposed, interconnected bights having a shape resembling that of a fishhook or an interrogation mark. One of the two bights revolves with the intermediate rotor and the other revolves with the outer rotor, and the two bights accordingly rotate in opposite directions relative to the base. The surface of revolution generated by the first-mentioned bight has to enclose the region in which the inner rotor rotates and to be enclosed by the area of revolution generated by the other bight.

When the outer rotor and the intermediate rotor—which preferably is supported by the outer rotor and in turn supports the inner rotor—and hence the two bights formed by the filiform transmission element, are rotating relative to the base at approximately equal speeds but in opposite directions, the inner rotor can rotate relative to the base in the same direction as, but approximately four times faster than, the intermediate rotor without twisting of the transmission element. With suitable design of the rotors and proper journalling of the transmission element in the rotors, the two bights may have a maximum radial dimension which is only 25 to 30 percent larger than the radius of the inner rotor, and hence the centrifugal field acting at the radially outermost portion of the transmission element need only be about one-twelfth of the centrifugal field acting at the radially outermost portion of the inner rotor. (The corresponding ratio in the known apparatus having only two rotors and a single bight is about 1:3.5.)

If the filiform transmission element is torsionally rigid, i.e. if it is capable of transmitting a sufficient torque without undue twisting, a separate drive for the inner rotor may be dispensed with, because a torsionally rigid transmission element will compel the inner rotor to rotate at a speed equal to twice the sum of the speeds of the outer rotor and the intermediate rotor.

For a more complete understanding of the invention an embodiment thereof is described with reference to the drawings, the embodiment illustrated being exemplary and not limitative. In the interest of clarity, the drawings are largely diagrammatic and some elements not essential for a complete understanding of the invention have been omitted.

ON THE DRAWINGS

AS SHOWN ON THE DRAWINGS

Figure 1:
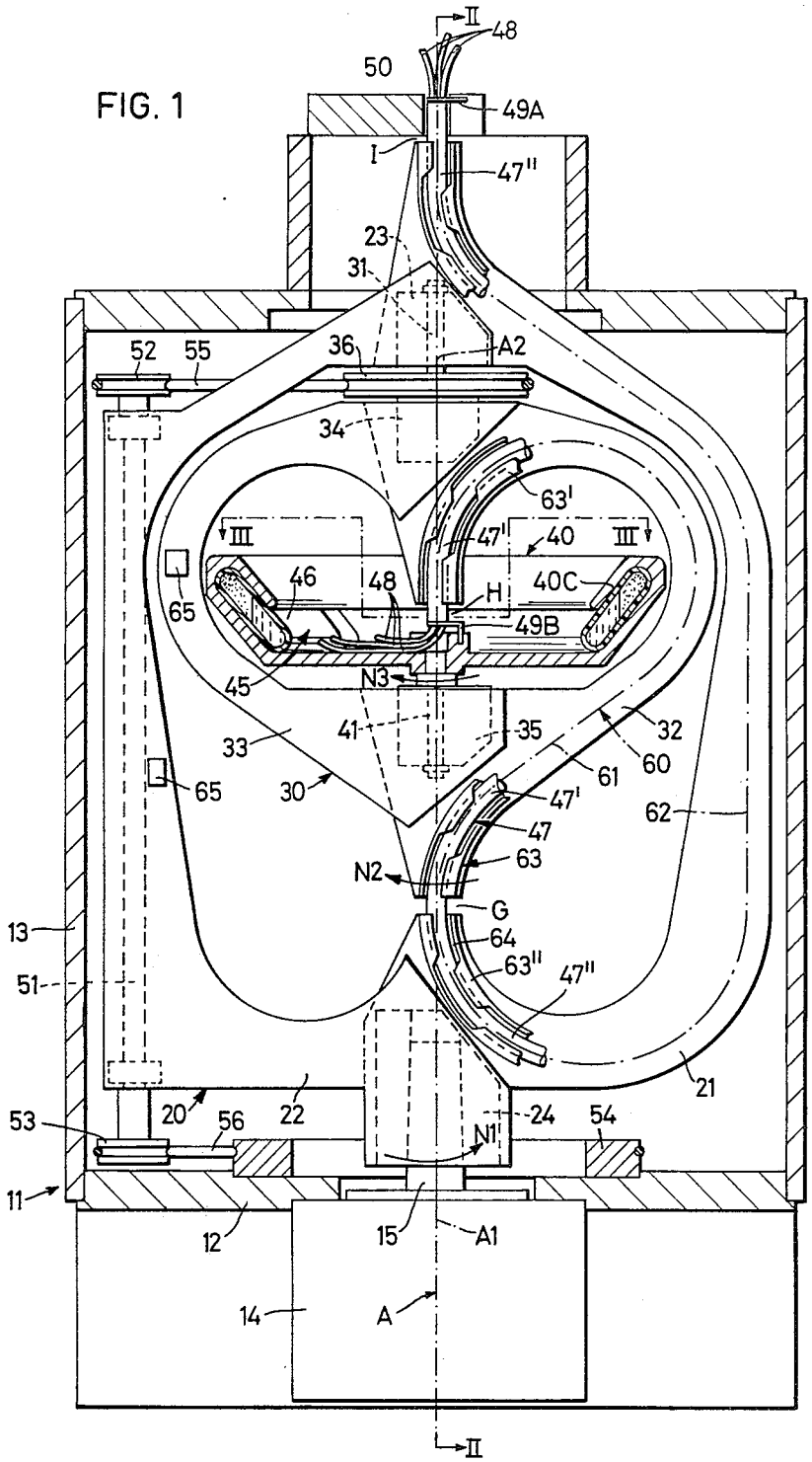
FIG. 1 is an elevational view, partly in section, of a centrifuge embodying the invention and intended for the continuous separation of blood.

The illustrated centrifuge comprises a base 11 including a base plate 12 and a housing 13 mounted on the base plate and enclosing the movable parts of the centrifuge. The housing can be opened in a manner not apparent from the drawings to provide access to the movable part. To the lower side of the base plate 12 is secured an electric motor 14 the shaft 15 of which is vertical and projects upwardly past the upper side of the base plate.

The shaft 15 carries a rotor 20, hereinafter referred to as the outer rotor, and as the shaft 15 rotates about its vertical axis A1, the outer rotor 20 is rotated at the same speed about the same axis, namely counterclockwise as seen from above in FIGS. 1 and 2.

The outer rotor 20 is essentially made up of two C-shaped flat bows 21 and 22 and a pair of upper and lower bearing blocks 23 and 24 through which the free ends of the two bows are rigidly fastened together. As shown in FIG. 1, the two opposed bows 21, 22 form a closed frame, and as shown in FIG. 2, the bows are disposed in vertical parallel planes and secured to opposite sides of the bearing blocks 23, 24.

The lower bearing block 24 is ro-rotatably secured to the motor shaft 15, and the upper bearing block 23 forms or is provided with a journal bearing for an intermediate rotor 30. The intermediate rotor 30 includes a vertical shaft 31 which is rotatable in the bearing block 23 about an axis A2 which is aligned with the axis A1 of the outer rotor 20, i.e. coincident with the extended axis A1. Thus, the intermediate rotor 30 is rotatable relative to the outer rotor 20 within the opening defined by the bows 21, 22.

The intermediate rotor 30 is constructed generally in the same manner as the outer rotor 20 and thus is made up of two C-shaped flat bows 32 and 33 and upper and lower bearing blocks 34 and 35 rigidly fastening the free ends of the bows together. The bows 32, 33 are likewise disposed in parallel vertical planes on opposite sides of the bearing blocks 34, 35 and form a frame defining an opening.

The upper bearing block 34 of the intermediate rotor 30 is rigidly fastened to the shaft 31 and to a pulley 36. The lower bearing block 35 forms a journal bearing for a cup-shaped inner rotor 40 which is rotatable within the opening defined by the intermediate rotor 30. A vertical shaft 41 of the inner rotor 40 is rotatable in the bearing block 35 about an axis A3 aligned with the axes A1 and A2 of the outer rotor 20 and the intermediate rotor 30, respectively. The three axes A1, A2 and A3 are commonly designated by A.

On the inner rotor 40 there is disposed a closed separation container forming part of a separation unit generally designated by 45. The separation unit, which is described in greater detail with reference to FIG. 4, comprises two main parts, namely the just-mentioned separation container 46 and a flexible filiform transmission element 47. The transmission element 47 comprises a bundle of three flexible tubes 48 fastened to the container 46 and communicating with the interior of the container at spaced locations, and it also comprises a sheathing 49 (FIGS. 3, 4) wrapped around the bundle of tubes. The sheathing 49 has a high degree of flexibility and in the illustrated embodiment is in the form of a densely coiled wire. One end of the sheathing 49 is non-rotatably connected to the inner rotor 40 and thus rotates therewith. As described more fully hereinafter, the filiform transmission element 47 extends from the inner rotor 40 through the intermediate rotor 30 and the outer rotor 20 to a holder or clamp 50 mounted on the top of the housing 13 where the other end of the sheathing 49 is non-rotatably fastened to the housing, i.e. to the base 11 of the centrifuge.

The pulley 36 secured to the intermediate rotor 30 forms part of a transmission system which serves to rotate the intermediate rotor 30 clockwise (as seen from above in FIGS. 1 and 2) relative to the base 11 at a speed equal or approximately equal to the speed at which the outer rotor 20 is rotated counterclockwise relative to the base. In addition to the pulley 36, this transmission system comprises a vertical shaft 51 journalled in the outer rotor and carrying an upper pulley 52 and a lower pulley 53, a pulley 54 rigidly fastened to the base plate 12 and coaxial with the motor shaft 15, a transmission rope or belt 55 interconnecting the pulleys 36 and 52, and a transmission rope or belt 56 interconnecting the pulleys 52 and 54.

The diameters of the pulleys 52 and 53 are approximately equal, and the diameter of the pulley 54 is approximately twice that of the pulley 36. If the outer rotor 20 is rotated at a speed N1 about the axis A, the intermediate rotor 30 will therefore rotate in the opposite direction at a speed N2 approximately equal to N1. The exact ratio of N1 and N2 of course depends on the ratios of the diameters of the pulleys. Advantageously N2 may be slightly larger than N1.

The filiform transmission element 47 extends between the inner rotor 40 and the holder 50 on the base 11 along a transmission path marked with a phantom line and designated by 60 in FIG. 1. This transmission path comprises two coherent bights, an inner bight 61 and an outer bight 62, which join with one another on the axis A at a gap G between the outer rotor 20 and the intermediate rotor 30. The two sections of the transmission element 47 extending along the bights 61 and 62 are designated respectively by 47' and 47''. The two ends of each bight are equidirected, i.e. they point in the same direction; the ends of the inner bight 61 pointing downwardly and the ends of the outer bight 62 pointing upwardly. As best shown in FIG. 1, the shape of the bights 61 and 62 resembles that of a fishhook or an interrogation mark. The two bights 61, 62 are held in a fixed position on the intermediate and outer rotors respectively, and when the rotors rotate as aforesaid, the two bights thus revolve about the vertical axis A. The surface of revolution generated by the inner bight 61 during such rotation is completely enclosed by the surface of revolution generated by the outer bight 62. This is apparent from FIG. 1 in which the two bights are shown in a common plane.

The transmission element 47 is held in position on the rotors 20 and 30 by a tubular guide 63 secured to the rotors and forming a journal bearing for the transmission element. Thus, the transmission element 47 can rotate relative to the rotors about its own curvilinear longitudinal axis represented by the line 60. Apart from a short interruption at the gap G, the guide 63 extends continuously between a point H on the axis A adjacent the inner rotor 40 to a point I likewise situated on the axis A immediately below the holder 50 on the base 11. The two sections of the guide 63 retaining the sections 47' and 47'' in position are designated respectively 63' and 63''.

In order that the transmission element 47 may easily be inserted in and removed from the guide 63, the guide is slotted at 64 throughout its length. The slot 64 is provided on the side of the guide facing away from the bows 21, 32. The slot 64 is slightly wider than the diameter of the transmission element 47 and is wavy to permit easy insertion and removal of the transmission element and still retain the transmission element in a reliable manner during the rotation of the rotors.

In an alternative embodiment (not shown) the slot is slightly narrower than the transmission element and defined by resilient flanks of a channel element. The material of the guide 63, i.e. the part of the guide engaging the transmission element, obviously should be chosen with a view to minimizing the frictional resistance to the rotation of the transmission element within the guide.

To prevent the ends of the transmission element 47 from rotating relative to the inner rotor 40 and the holder 50 on the base, there are provided on the just-mentioned parts, near the respective adjacent end of the guide 63, coupling members which can be engaged by coupling members on the sheathing 49 after the transmission element 47 has been inserted in the guide. In the illustrated embodiment the coupling members on the inner rotor 40 and the holder 50 are in the form of a groove or other recess, and the coupling members at the ends of the sheathing are formed by projecting end portions 49A, 49B of the spring wire from which the sheathing is wound. Naturally, couplings of any other suitable type may be used.

The two bows 22 and 33 not supporting the guide 63 are provided with weights 65 (FIG. 1) balancing a larger or smaller portion of the extra weight constituted by the guide 63 and the transmission element 47 with the liquid-filled tubes inserted in the guide. A coarse balancing may be effected through a suitable dimensioning of the bows.

Figure 2:
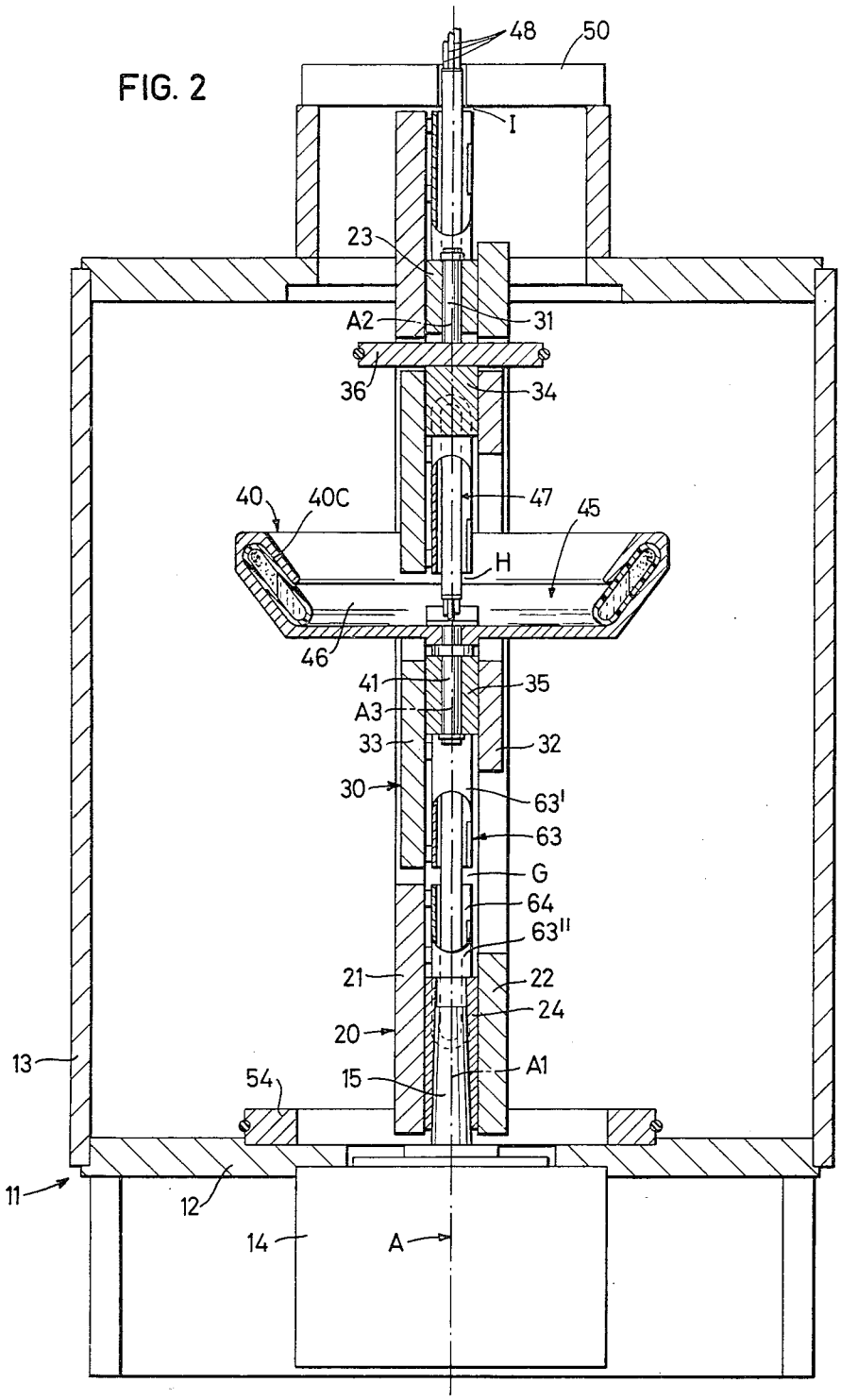
FIG. 2 is a view in vertical section on line II—II of FIG. 1.

Omitted from the drawings in the interest of clarity are a pair of journal bearings which are respectively provided at the locations designated G and I in FIGS. 1 and 2 to ensure that the intermediate rotor 30 and the outer rotor 20 remain accurately centered on the axis A during the rotation of the rotors. Such bearings are formed by sleeves which are coaxial with and supported by both rotors 30, 20. To permit insertion of the transmission element 47, the sleeves are slotted axially.

When the outer rotor 20 and the intermediate rotor 30 rotate in the above-described manner, that is, respectively counterclockwise at a speed N1 and clockwise at a speed N2, the inner rotor 40 and, accordingly, the separation container 46 and the adjacent end of the transmission element 47, will rotate clockwise at a speed $N3=2(N1+N2)$. This result requires the transmission element 47 to possess sufficient torsional rigidity to be able to transmit the torque required to rotate the inner rotor 40 at a speed N3 without becoming unduly twisted. With a suitable design of the sheathing 49, a twisting of several turns may be accepted. Naturally, the twisting must not be allowed to cause the sheathing 49 to become distorted so as to jam in the guide 63 or pinch the tubes 48. The degree of twisting may be allowed to vary during the operation of the centrifuge with consequent variation of the ratios of the speeds of the rotors.

No exact ratio of the rotational speeds of the outer and intermediate rotors need be maintained. Some degree of slipping or lag of one of these rotors relative to the other thus does not necessarily cause twisting of the transmission element 47. Consequently a simple transmission system interconnecting the rotors may be used.

In the above-described centrifuge the separation unit 45 is a disposable item and it is thus replaced when blood from a different donor or source is to be separated. It is important, therefore, that the separation unit can easily and quickly be inserted in and removed from the centrifuge.

Figure 3:
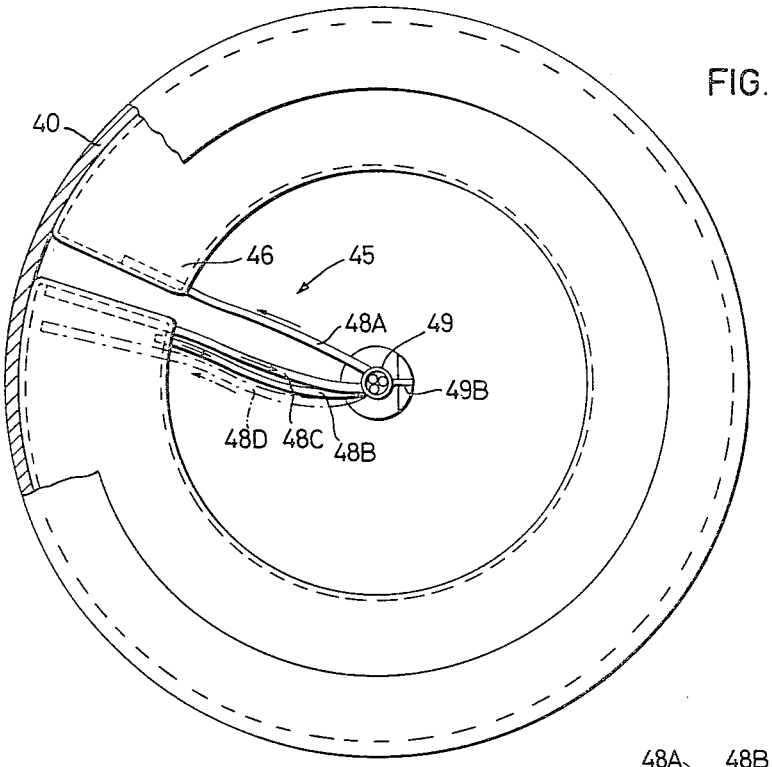
FIG. 3 is a plan view of the inner rotor and the separation container carried thereby.
Figure 4:
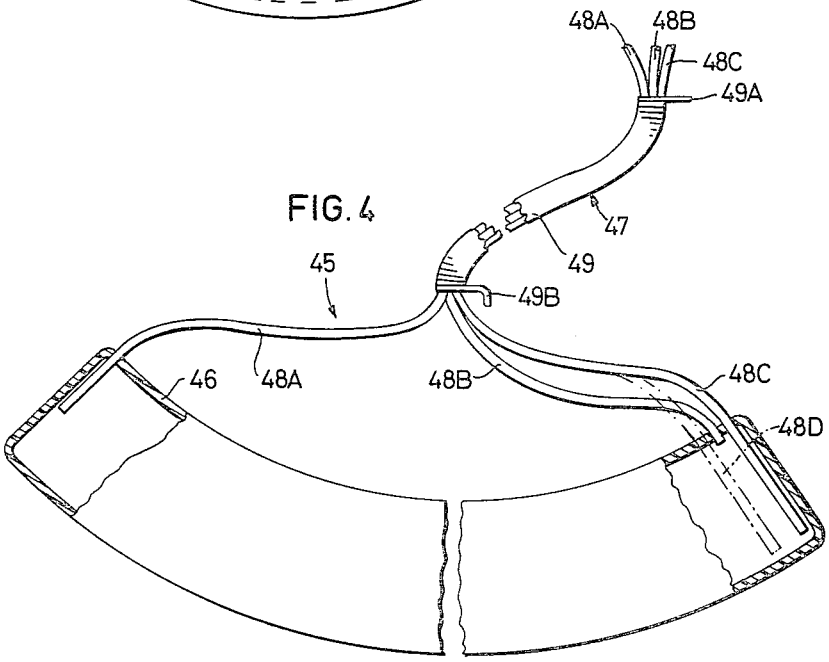
FIG. 4 shows the separation container with its flexible tubes and sheathing for the tubes when removed from the inner rotor.

The separation container 46 of the separation unit 45 is made from soft, pliable sheet material, such as polyethylene. It may be constructed as a closed annulus. When the rotors 20 and 30 assume the relative position shown on the drawings, the annular container may be inserted between the inner rotor 40 and the portions of the intermediate rotor 30 and the guide 63 projecting downwardly into the inner rotor and then placed in the proper position on the inner rotor. It is preferred, however, to construct the container as shown in FIGS. 3 and 4; the elongated shape shown in these figures facilitates the insertion of the container in the proper position on the inner rotor. As shown in FIGS. 1 and 2, the inner rotor 40 has a frusto-conical pocket 40C which confers on the container 46 a shape permitting the utilization of the angle effect, thereby providing for a quick and efficient separation of the blood into a plasma fraction and a blood cell fraction.

FIG. 3 shows the inner rotor 40 with the separation container 46 disposed therein, as seen from line III—III of FIG. 1, while FIG. 4 shows the complete separation unit 45 when removed from the inner rotor.

The separation container 45 is constructed as a length of a flattened, curved tube which is closed at both ends. When inserted in the inner rotor 40 as shown in FIGS. 1 to 3, the tubular container forms a concentric, interrupted annulus with the ends adjacent each other, and when removed from the inner rotor it is shaped as shown in FIG. 4.

In FIGS. 3 and 4 the above-mentioned flexible tubes 48 are designated 48A, 48B and 48C. They are fixedly secured to the separation container 46 in or near the inner peripheral wall thereof. The tube 48A serves to feed the unseparated blood into the separation container 46, and as shown in both figures, it enters the container at one end of the flattened tube forming the container. It opens within the container approximately halfway between the inner and outer peripheral walls, i.e. at the place where the interface between the heavier blood cell fraction and the lighter plasma fraction lies during the continuous separation process.

The tube 48B serves to withdraw the plasma fraction and enters the separation container adjacent the opposite end thereof and opens near the inner peripheral wall. The third tube 48C enters the container at the same end as the plasma tube but opens near the outer peripheral wall. It serves to withdraw the blood cell fraction.

The blood cell fraction may be rather viscous. The discharging of this fraction from the separation container is facilitated if the bundle of flexible tubes includes a fourth flexible tube opening immediately adjacent the tube 48C and continuously feeding saline or other suitable diluent to the region of the vessel where the blood cell fraction enters the tube 48C. Such a fourth tube is indicated at 48D. The blood cells will become suspended in the diluent, and the suspension thus formed can easily enter the tube 48C even if this tube is narrow.

As shown in FIGS. 3 and 4, the tubes 48A, 48B, 48C and 48D extend freely over a distance between the inner end of the sheathing 49 and the separation container 46, i.e. from the center portion of the inner rotor 40 to the separation container 46 when the separation unit 45 is inserted in the centrifuge. However, the tubes may be arranged to be held in a fixed position over this distance as well, although doing so is hardly necessary in practice.

In a modified embodiment (not shown) of the separation unit 45, the blood feed tube 48A enters or is secured to the separation container 46 near the end where the other tubes are connected to the container. The blood feed tube then runs along the separation container (either within or on the outer side) to the opposite end where it opens halfway between the inner and outer peripheral walls as set forth above. In this embodiment all tubes thus may form a bundle all the way from the separation container.

The insertion and removal of the separation unit may be facilitated by a modified mounting of the inner rotor 40 on the intermediate rotor 30. With this modified mounting, which is not illustrated, the inner rotor 40 is readily removable from the intermediate rotor 30, so that the separation container 46 can be inserted in its pocket in the inner rotor with the latter removed from the centrifuge. After the separation container has been properly positioned in its pocket, the inner rotor is again mounted on the intermediate rotor and the transmission element 47 is inserted in the guide 63.

In a further modified embodiment (not shown) the pocket 40C in the inner rotor 40 is inverted so that it tapers upwardly and is open along its upper edge. In this modified embodiment, the angle of inclination of the sidewalls of the pocket varies continuously in the circumferential direction; the angle included between the sidewalls and the axis A has its minimum value at the region where the blood enters the separation container and increases continuously towards the region where the separated fractions are withdrawn from the separation container. The fractions into which the blood is separated accordingly are subjected to forces tending to cause the fractions to flow towards the end of the tubular separation container where the outlet tubes communicate with the interior of the separation container. In this way a particularly efficient separation is achieved.

The separation is improved still further by another feature of the above-described modified embodiment; the cross-sectional area of the tubular separation container 46, and of the pocket 40C in the inner rotor 40 receiving the separation container, increases gradually from the inlet end of the separation container towards the outlet end. As a consequence of the increasing cross-section the rate of flow in the longitudinal or circumferential direction of the separation container decreases gradually from the inlet end towards the outlet end so that the risk of unwanted intermixing of the separated fractions is minimized.

The portions of the tubes 48 emerging from the outer end of the sheathing 49 may be connected to conventional accessories or auxiliary equipment, either permanently or through separable sterile couplings. If the separation is carried out as a step in the so-called plasmapheresis in vivo, the blood feed tube 48A and the blood cell tube 48C may thus be connected to different branches of a bifurcated cannula inserted in a vein of the blood donor or the patient, while the plasma tube 48B is connected to a collecting vessel for blood plasma. During the separation one or more peristaltic pumps operate in a conventional manner on the tubes between the separation container 46 and the accessories or auxiliary equipment.

In the illustrated exemplary embodiment of the separation unit 45, the sheathing 49, which serves as a torsionally rigid flexible shaft, is made from a coiled wire the ends of which are bent to form the above-mentioned coupling members 49A and 49B. It is also possible, however, to use other types of shafts capable of transmitting the torque required for the rotation of the inner rotor without becoming twisted such that the tubes are pinched or damaged or jamming in the guide occurs. Although it is normally preferred that the shaft permanently forms part of the separation unit, i.e. is discarded together with the rest of the separation unit, it is within the scope of the invention to use a shaft which can be combined with and separated from the separation unit.

Although the invention has been described with particular reference to its use in a centrifuge, it is also useful in other instances where it is necessary to maintain a continuous communication path between continuously rotating parts without resorting to sliding-contact or rotary-seal connecting devices, such as instances where it is required to transmit electric currents, gas or liquid streams or electrical, optical, pneumatic or hydraulic signals from a stationary terminal to a continuously rotating terminal.

It is also within the scope of the invention to provide more than three relatively rotating rotors to achieve a further reduction of the speed at which the bights of the filiform transmission element revolve relative to the base. The additional rotors are disposed between the base and the outer rotor described above and each rotor is arranged to rotate opposite to the next inner rotor and guide the transmission element around that rotor in a bight having its ends pointing in the same direction.

It is not always necessary to have one end of the transmission element non-rotatably fastened to the base, although such fastening is normally required or desirable. In other words, it is within the scope of the invention to have both ends rotating relative to the base. In this regard it should also be noted that as applied to the filiform transmission element in this specification and the claims, the term "end" is not to be construed as strictly limited to actual ends or terminations of the transmission element. Accordingly, "ends" should be construed as embracing more or less arbitrary points on or sections of the transmission element which define a length of the transmission element and have to be allowed to rotate relative to one another indefinitely. For example, in the separation unit 45 described above, the sheathing 49 and/or the tubes 48 enclosed in it may continue from the outer rotor 20 past the holder 50, e.g. to a cannula and container assembly. In such case, the "end" of the transmission element non-rotatably fastened to the base of the centrifuge is formed by a section of the sheathing and tubes which is situated between the actual ends of these elements.

Another term which is intended to be construed in a wide sense and also refers to the transmission element is "filiform". This term is only intended to characterize the transmission element as being elongated and slender and having a substantially constant cross-section over at least a substantial portion of its length.

I claim as my invention:

1. Apparatus for accomplishing unlimited unidirectional relative rotation of the ends of a filiform, flexible transmission element, comprising:

a base, a first rotor which is rotatable relative to the base about a first axis (A1), a second rotor which is rotatable relative to the first rotor and the base about a second axis (A3), said second axis being substantially parallel to the first axis, a third rotor which is rotatable relative to the base and the first and the second rotors about a third axis (A2) substantially parallel to the first and second axes (A1, A3), and drive means operable to rotate the first and third rotors in opposite directions relative to the base and to rotate the second rotor in the same direction as the third rotor at a rotational speed (N3) equal to twice the sum of the rotational speeds (N1, N2) of the first and third rotors, first fastening means for non-rotatably fastening one end of the transmission element to the base near the first axis (A1), second fastening means for non-rotatably fastening the other end of the transmission element to the second rotor near the second axis (A3), means for holding a first length of the transmission element in position on the first rotor along a bight line extending from a point (I) near the first fastening means out around the region occupied by the second rotor and back to a point (G) near the first axis (A1), the ends of the bight line pointing in the same direction, means for holding a second length of the transmission element in position on the third rotor along a second bight line having its ends pointing in the same direction and forming a continuation of the first bight line, said second bight line at one end thereof (H) extending from the second rotor near the second fastening means and out around the region occupied by the second rotor inwardly of the first bight line and back to a point (G) near the third axis (A2) where it merges with the first bight line, the transmission element being rotatable relative to the first and second rotors in said holding means.

2. Apparatus according to claim 1, in which the first rotor is supported by the base and the first, second and third axes (A1, A2, A2) are aligned.

3. Apparatus according to claim 1 or 2, in which the drive means includes a motor for directly driving the first rotor, a transmission system for transmitting rotational motion between the motor and the third rotor, and a torsionally rigid flexible shaft, one end of which is non-rotatably secured to the base by means of the first fastening means and the other end of which is non-rotatably connected to the second rotor by means of the second fastening means, the flexible shaft extending along the first and second bight lines and being rotatable about its curvilinear longitudinal axis relative to the first and third rotors.

4. Apparatus according to claim 3, in which the flexible shaft is hollow and encloses at least one flexible tube.

5. Apparatus according to claim 3, in which the first and third rotors each comprise a guide member extending along respectively the first bight line and the second bight line and forming a journal bearing for the flexible shaft.

6. Apparatus according to claim 5, in which the flexible shaft is laterally insertable into and removable from the guide members.

7. Centrifuge apparatus for continuous separation of a liquid into fractions of different densities, comprising:

a base, inner, intermediate and outer rotors which are rotatable relative to one another and relative to the base about a common centrifuge axis, drive means for rotating the intermediate and outer rotors in opposite directions at approximately the same speed and for rotating the inner rotor in the same direction as the intermediate rotor at a speed equal to twice the sum of the speeds of the intermediate and outer rotors, a filiform flexible transmission element having one end thereof non-rotatably fastened to the base and having the opposite end thereof non-rotatably fastened to the inner rotor, first holding means holding a first length of the transmission element in position on the outer rotor along a first bight line extending from a point near the centrifuge axis out around the region occupied by the intermediate rotor and back to the centrifuge axis, the ends of the bight lines pointing in the same direction along the centrifuge axis, second holding means holding an adjoining second length of the transmission element in position on the intermediate rotor along a second bight line forming a continuation of the first bight line and having both ends thereof pointing along the centrifuge axis oppositely to the direction of the ends of the first bight line so that the ends of the transmission element point in opposite directions along the centrifuge axis, the second bight line extending from the inner rotor out around the region occupied by the inner rotor inwardly of the first bight line and back to the centrifuge axis where it merges with the first bight line, a separation container removably held on the inner rotor, and flexible inlet and outlet tubes, each fixedly secured at one end thereof to the separation container for passing liquid into and out of the separation container, said tubes extending together with the transmission element along the first and second bight lines and said transmission element and tubes being rotatable in said first and second holding means relative to the outer and intermediate rotors.

8. Centrifuge apparatus according to claim 7 in which the drive means includes a motor for directly rotating the outer rotor and a transmission system drivingly interconnecting the outer and intermediate rotors and in which the transmission element is torsionally rigid whereby during the rotation of the outer and intermediate rotors in opposite directions the transmission element rotates the inner rotor in the direction in which the intermediate rotor is rotated by the transmission system.

9. Centrifuge apparatus according to claim 8 in which the transmission element is hollow and encloses the inlet and outlet tubes of the containers.

10. Apparatus according to claim 4, in which the first and third rotors each comprise a guide member extending along respectively the first bight line and the second bight line and forming a journal bearing for the flexible shaft.

11. Apparatus according to claim 10, in which the flexible shaft is laterally insertable into and removable from the guide members.

12. A detachable separation unit for use in a centrifuge apparatus of the type having a stationary base, at least two rotors mounted in the base for rotation relative to one another and relative to the base about a centrifuge axis, drive means for rotating the rotors at different speeds, one of the rotors having means for receiving a separation container, and the other rotor having holding means for holding a bundle of flexible tubes fastened to the separation container in position on said other rotor during the relative rotation, said separation unit comprising in combination:

(A) A closed container of flexible sheet material receivable in a pocket on said one rotor, said container having an internal tubular configuration and its external ends being free of each other;

(B) A bundle of flexible tubes fastened to said closed container, at least one of said flexible tubes opening into said container near one end thereof and at least one of the other flexible tubes opening into said container near the opposite end thereof; and (C) An elongated, flexible but torsionally rigid sheathing enclosing said bundle of flexible tubes and including means for non-rotatably detachably fastening the ends thereof respectively to the base and said one rotor.

13. A detachable separation unit according to claim 12, said detachable fastening means comprising a radially projecting wire receivable in slots on the base and said one rotor.

* * * * *